US006533898B2

(12) United States Patent
Gross

(10) Patent No.: US 6,533,898 B2
(45) Date of Patent: Mar. 18, 2003

(54) SOFTENED COMMINUTION PULP

(75) Inventor: James R. Gross, Cordova, TN (US)

(73) Assignee: BKI Holding Corporation, Wilmington, DE (US)

( * ) Notice: Subject to any disclaimer, the term of this patent is extended or adjusted under 35 U.S.C. 154(b) by 0 days.

(21) Appl. No.: 10/017,361

(22) Filed: Dec. 14, 2001

(65) Prior Publication Data

US 2002/0074097 A1 Jun. 20, 2002

Related U.S. Application Data

(63) Continuation of application No. 09/345,328, filed on Jun. 30, 1999, now Pat. No. 6,344,109.

(60) Provisional application No. 60/112,887, filed on Dec. 18, 1998.

(51) Int. Cl.[7] ..... D21H 17/03

(52) U.S. Cl. ..... 162/158; 162/100; 162/175; 162/9

(58) Field of Search ..... 162/100, 9, 158, 162/182, 175

(56) References Cited

U.S. PATENT DOCUMENTS

| | | | | |
|---|---|---|---|---|
| 2,046,763 | A | 7/1936 | Asnes | 91/68 |
| 3,400,717 | A | 9/1968 | Cubitt et al. | 128/284 |
| 3,406,668 | A | 10/1968 | Donnelly et al. | 123/90 |
| 3,406,688 | A | 10/1968 | Cubitt et al. | 128/284 |
| 3,617,439 | A | 11/1971 | Chapman, Jr. | 162/158 |
| 3,930,933 | A | 1/1976 | George et al. | 162/179 |
| 3,972,855 | A | 8/1976 | Martinsson et al. | 260/567.6 M |
| 4,098,996 | A | 7/1978 | Ryan et al. | 536/57 |
| 4,103,062 | A | 7/1978 | Aberson et al. | 428/283 |
| 4,144,122 | A | 3/1979 | Emanuelsson et al. | 162/158 |
| 4,303,471 | A | 12/1981 | Laursen | 162/158 |
| 4,318,963 | A | 3/1982 | Smith | 428/537 |
| 4,324,820 | A | 4/1982 | Weldon | 427/420 |
| 4,345,970 | A | 8/1982 | Radvan et al. | 162/123 |
| 4,377,985 | A | 3/1983 | Reba | 118/315 |
| 4,410,571 | A | 10/1983 | Korpman | 427/385.5 |
| 4,412,036 | A | 10/1983 | Pedersen et al. | 525/54.26 |
| 4,414,252 | A | 11/1983 | Lampkin | 427/424 |
| 4,421,800 | A | 12/1983 | Schoenberg et al. | 427/424 |
| 4,425,186 | A | 1/1984 | May et al. | 162/158 |
| 4,432,833 | A | 2/1984 | Breese | 162/158 |
| 4,444,830 | A | 4/1984 | Erickson | 428/246 |
| 4,448,818 | A | 5/1984 | Hartog et al. | 427/424 |
| 4,448,821 | A | 5/1984 | Buschor | 427/424 |
| 4,467,012 | A | 8/1984 | Pedersen et al. | 428/248 |
| 4,481,076 | A | 11/1984 | Herrick | 162/158 |
| 4,481,077 | A | 11/1984 | Herrick | 162/158 |
| 4,486,501 | A | 12/1984 | Holbek | 428/375 |
| 4,521,462 | A | 6/1985 | Smythe | 427/421 |
| 4,536,432 | A | 8/1985 | Holtman | 428/171 |
| 4,538,765 | A | 9/1985 | Mayr et al. | 241/21 |
| 4,563,243 | A | 1/1986 | Koch et al. | 162/18 |
| 4,596,567 | A | 6/1986 | Iskra | 604/368 |
| 4,601,921 | A | 7/1986 | Lee | 427/240 |
| 4,605,402 | A | 8/1986 | Iskra | 604/368 |
| 4,615,816 | A | 10/1986 | Ogiso et al. | 252/8.9 |
| 4,632,848 | A | 12/1986 | Gosset et al. | 427/154 |
| 4,655,758 | A | 4/1987 | Ring et al. | 604/374 |
| 4,666,763 | A | 5/1987 | King et al. | 428/221 |
| 4,731,269 | A | 3/1988 | Hansen et al. | 428/36 |
| 4,762,750 | A | 8/1988 | Girgis et al. | 428/378 |
| 4,795,530 | A | 1/1989 | Soerens et al. | 162/111 |
| 4,826,704 | A | 5/1989 | Walser | 427/28 |
| 4,826,880 | A | 5/1989 | Lesniak et al. | 521/53 |
| 4,839,202 | A | 6/1989 | Grassel et al. | 427/424 |
| 4,853,086 | A | 8/1989 | Graef | 162/157.6 |
| 4,860,685 | A | 8/1989 | Smith | 118/300 |
| 4,891,249 | A | 1/1990 | McIntyre | 427/421 |
| 4,917,762 | A | 4/1990 | Dalkiaer | 162/5 |
| 4,944,960 | A | 7/1990 | Sundholm et al. | 427/27 |
| 5,008,359 | A | 4/1991 | Hunter | 527/103 |
| 5,009,650 | A | 4/1991 | Bernardin | 604/378 |
| 5,038,997 | A | 8/1991 | St. Charles | 229/3.1 |
| 5,041,104 | A | 8/1991 | Seal | 604/367 |
| 5,057,166 | A | 10/1991 | Young, Sr. et al. | 156/62.2 |
| 5,064,689 | A | 11/1991 | Young, Sr. et al. | 427/202 |
| 5,094,888 | A | 3/1992 | Kamienski et al. | 427/296 |
| 5,128,082 | A | 7/1992 | Makoui | 264/112 |
| 5,140,086 | A | 8/1992 | Hunter et al. | 527/103 |
| 5,147,343 | A | 9/1992 | Kellenberger | 604/368 |
| 5,149,335 | A | 9/1992 | Kellenberger et al. | 604/372 |
| 5,176,668 | A | 1/1993 | Bernardin | 604/368 |
| 5,178,788 | A | 1/1993 | Marquis et al. | 252/162 |
| 5,195,999 | A | 3/1993 | Harada et al. | 604/368 |
| 5,230,959 | A | 7/1993 | Young, Sr. et al. | 428/372 |
| 5,240,562 | A | 8/1993 | Phan et al. | 162/158 |
| 5,246,545 | A | 9/1993 | Ampulski et al. | 162/112 |
| 5,262,005 | A | 11/1993 | Eriksson et al. | 162/100 |
| 5,277,763 | A | 1/1994 | Debaux et al. | 162/145 |
| 5,300,192 | A | 4/1994 | Hansen et al. | 162/184 |
| 5,308,658 | A | 5/1994 | Morris | 427/421 |
| 5,308,896 | A | 5/1994 | Hansen et al. | 524/13 |
| 5,334,286 | A | 8/1994 | Van Phan et al. | |
| 5,334,445 | A | 8/1994 | Ruyter et al. | 428/284 |
| 5,350,600 | A | 9/1994 | Kubota | 427/256 |

(List continued on next page.)

FOREIGN PATENT DOCUMENTS

| | | | |
|---|---|---|---|
| WO | WO 98/15689 | 4/1998 | D21H/17/04 |
| WO | WO 98/31858 | 7/1998 | D04H/1/70 |

*Primary Examiner*—Peter Chin
(74) *Attorney, Agent, or Firm*—Darby & Darby

(57) ABSTRACT

The present invention relates to processes for softening cellulose pulp using chemical softening agents or debonders, which include compositions comprising lower alkyl acid esters or cyclic esters of polyhydroxy compounds, without adversely affecting the absorbency of the cellulose fiber products thereof, and products thereof. The process of the invention may also be used in combination with plasticizing agents for cellulose such as glycerol, mono- and di-saccharides, glycols, and oligomers thereof. The process of the invention provides cellulosic fiber which is easier to fluff (refiberize) and to subsequently densify airlaid pads formed from the resulting individualized fibers, without adversely affecting absorbency.

8 Claims, 3 Drawing Sheets

U.S. PATENT DOCUMENTS

| | | | | |
|---|---|---|---|---|
| 5,352,480 | A | 10/1994 | Hansen et al. | 427/202 |
| 5,360,516 | A | 11/1994 | Cutright et al. | 162/139 |
| 5,362,766 | A | 11/1994 | Hopkins, Jr. et al. | 523/105 |
| 5,378,528 | A | 1/1995 | Makoui | 428/219 |
| 5,385,643 | A | 1/1995 | Ampulski | 162/135 |
| 5,389,181 | A | 2/1995 | Vukos et al. | 156/264 |
| 5,399,240 | A | 3/1995 | Graef et al. | |
| 5,419,955 | A | 5/1995 | Ehrhardt et al. | 428/283 |
| 5,432,000 | A | 7/1995 | Young, Sr. et al. | 428/372 |
| 5,447,977 | A | 9/1995 | Hansen et al. | 524/13 |
| 5,498,478 | A | 3/1996 | Hansen et al. | 428/372 |
| 5,516,545 | A | 5/1996 | Sandock | 427/76 |
| 5,516,585 | A | 5/1996 | Young, Sr. et al. | 428/372 |
| 5,522,810 | A | 6/1996 | Allen, Jr. et al. | 604/366 |
| H1565 | H | 7/1996 | Brodof et al. | 604/368 |
| 5,534,114 | A | 7/1996 | Cutright et al. | 162/139 |
| 5,538,783 | A | 7/1996 | Hansen et al. | 428/283 |
| 5,543,215 | A | 8/1996 | Hansen et al. | 428/283 |
| 5,547,541 | A | 8/1996 | Hansen et al. | 162/12 |
| 5,547,745 | A | 8/1996 | Hansen et al. | 428/283 |
| 5,554,657 | A | 9/1996 | Brownscombe et al. | 521/48 |
| 5,560,807 | A | 10/1996 | Hauser | 162/183 |
| 5,562,649 | A | 10/1996 | Chauvette et al. | 604/375 |
| 5,571,618 | A | 11/1996 | Hansen et al. | 428/359 |
| 5,575,891 | A | 11/1996 | Trokhan et al. | 102/111 |
| 5,580,922 | A | 12/1996 | Park et al. | 524/733 |
| 5,589,256 | A | 12/1996 | Hansen et al. | 428/283 |
| 5,607,414 | A | 3/1997 | Richards et al. | 604/378 |
| 5,607,759 | A | 3/1997 | Hansen et al. | 442/417 |
| 5,609,727 | A | 3/1997 | Hansen et al. | 162/184 |
| 5,611,885 | A | 3/1997 | Hansen et al. | 156/326 |
| 5,614,570 | A | 3/1997 | Hansen et al. | 524/13 |
| 5,622,599 | A | 4/1997 | Sproule et al. | 162/186 |
| 5,624,532 | A | 4/1997 | Trokhan et al. | 162/111 |
| 5,629,277 | A | 5/1997 | Plishka | 510/202 |
| 5,633,043 | A | 5/1997 | Hiraga et al. | 427/421 |
| 5,633,044 | A | 5/1997 | Linnonmaa | 427/421 |
| 5,641,561 | A | 6/1997 | Hansen et al. | 442/417 |
| 5,649,915 | A | 7/1997 | Chauvette et al. | 604/375 |
| 5,654,031 | A | 8/1997 | Delmore et al. | 427/8 |
| 5,670,202 | A | 9/1997 | Guzowski et al. | 427/8 |
| 5,672,418 | A | 9/1997 | Hansen et al. | 428/283 |
| 5,674,339 | A | 10/1997 | Groeger et al. | 156/145 |
| 5,683,752 | A | 11/1997 | Popp et al. | 427/421 |
| 5,693,411 | A | 12/1997 | Hansen et al. | 428/283 |
| 5,695,486 | A | 12/1997 | Broughton et al. | 604/374 |
| 5,710,434 | A | 1/1998 | Park et al. | 252/182.2 |
| 5,720,736 | A | 2/1998 | Hatsuda et al. | 604/368 |
| 5,725,736 | A | 3/1998 | Schroeder et al. | 162/164.4 |
| 5,744,190 | A | 4/1998 | Thome | 427/8 |
| 5,756,163 | A | 5/1998 | Watanabe | 427/430.1 |
| 5,776,308 | A | 7/1998 | Sears et al. | 162/158 |
| 5,776,598 | A | 7/1998 | Huber et al. | 428/298 |
| 5,779,857 | A | 7/1998 | Norlander | 162/157.6 |
| 5,789,326 | A | 8/1998 | Hansen et al. | 442/59 |
| 5,797,893 | A | 8/1998 | Wada et al. | 604/372 |
| 5,807,364 | A | 9/1998 | Hansen | 604/367 |
| 5,837,627 | A | 11/1998 | Halabisky et al. | 442/385 |
| 5,840,403 | A | 11/1998 | Trokhan et al. | 428/154 |
| 5,840,787 | A | 11/1998 | West et al. | 524/35 |
| 5,849,321 | A | 12/1998 | Linnonmaa | 427/421 |
| 5,858,172 | A | 1/1999 | Sears et al. | 162/158 |
| 5,866,242 | A | 2/1999 | Tan et al. | 428/219 |

Debonders on Pulp

Propylene Carbonate-Dextrose

Propylene Carbonate-Glycerin

SOFTENED COMMINUTION PULP

RELATED APPLICATIONS

This is a continuation, of application Ser. No. 09/345,328 filed Jun. 30, 1999 now U.S. Pat. No. 6,344,109, which in turn claims the benefit of U.S. Provisional Application Serial No. 60/112,887 filed Dec. 18, 1998. Each of these prior applications is hereby incorporated herein by reference, in its entirety.

FIELD OF THE INVENTION

The present invention relates to processes for softening cellulose pulp using chemical softening agents, including debonders such as compositions containing lower alkyl acid esters or cyclic esters of polyhydroxy compounds and polyhydroxy-functional plasticizers, products thereof, and the like.

BACKGROUND OF THE INVENTION

Highly engineered absorbent articles such as premium baby diapers, adult incontinence devices, and feminine napkins are typically made with a cellulose fiber fluff-based absorbent core positioned below a liquid pervious top sheet and a low density acquisition or surge layer. The acquisition layer allows the temporary storage and unobstructed passage of fluid to the absorbent core while acting as a barrier to the retransfer of liquid back to the skin of the user. A liquid impervious backing sheet, usually of plastic material, is also provided to contain the absorbed fluid and prevent it from passing through the absorbent core and soiling the undergarments of the wearer of the absorbent article. The acquisition layer typically includes chemically stiffened cellulose fluff or bonded synthetic fibers, wherein the fibers are bonded with thermoplastic binder fibers or powder, or via the application of a latex binder.

The absorbent core of these absorbent articles is usually constructed of defiberized wood pulp with or without superabsorbent polymer granules. The absorbent core is typically formed on a pad forming unit of a converting machine on a carrier tissue to facilitate processing. Some absorbent core forming units are equipped with a layering capability in which a second discrete fluff layer may be laid over a primary fluff-based absorbent layer to form a multi-layer absorbent structure. In these absorbent structures, the primary layer may include superabsorbent polymer granules. Examples of conventionally produced absorbent structures include those described in U.S. Pat. Nos. 5,009,650; 5,378,528; 5,128,082; 5,607,414; 5,147,343; 5,149,335; 5,522,810; 5,041,104; 5,176,668; 5,389,181; and 4,596,567.

The manufacture of disposable absorbent hygienic products, particularly diapers and adult incontinence products, is usually performed on a continuous production line in which the cellulose fluff absorptive material is supplied as a roll of comminution pulp. The pulp is manufactured by conventional wet-laid techniques, wherein the pulp sheet is unrolled and fed into a hammer mill or similar mechanical apparatus to separate the cellulose fibers in the sheet into cellulose fluff. A drying stage may or may not be needed ahead of the hammer mill, depending on the needs of the skilled artisan employing the process of the invention. The fluff is then conveyed to the forming area where it is air-laid in the amount and shape desired in the final product.

To soften the sheeted product for efficient comminution, cationic surfactants have been used traditionally as debonders to disrupt interfiber associations, thereby producing a softer and weaker sheeted product. Examples of debonders are disclosed in U.S. Pat. No. 4,432,833; U.S. Pat. No. 4,425,186; and U.S. Pat. No. 5,776,308. A common drawback to the conventional cationic debonders is a loss of wettability or absorbency of the comminution pulp due to the relatively long alkyl chain of the cationic surfactant. Blocking hydrogen-bonding sites softens the pulp sheet so it is more easily comminuted into individual fibers. Debonders also encourage the formation of lofty, low density airlaid structures which resist permanent densification since the hydrogen bonds between fibers are blocked by the debonder molecules. Thus, it would be advantageous to produce a comminuted pulp product which is easily densified for use in a final air-laid or woven product, without loss of wettability or absorbency.

Plasticizers for cellulose, which can be added to a pulp slurry prior to forming wetlaid sheets, can also be used to soften pulp, although they act by a different mechanism than debonding agents. Plasticizing agents act within the fiber, at the cellulose molecule, to make flexible or soften amorphous regions. The resulting fibers are characterized as limp. Since the plasticized fibers lack stiffness, the comminuted pulp is easier to densify compared to fibers not treated with plasticizer.

Plasticizers include polyhydric alcohols such as glycerol; low molecular weight polyglycols such as polyethylene glycols and polypropylene glycols; and other polyhydroxy compounds. These and other plasticizers are described and exemplified in U.S. Pat. No. 4,098,996; U.S. Pat. No. 5,547,541; and U.S. Pat. No. 4,731,269. Ammonia, urea, and alkylamines are also known to plasticize wood products, which mainly contain cellulose (A. J. Stamm, Forest Products Journal 5(6):413, 1955.

Plasticizing provides for easier densification of airlaid nonwovens made from treated pulp after comminution. A method of softening a cellulose composition that effectively debonds pulp fibers for efficient comminution, thereby making it easier to refiberize and subsequently densify without decreasing wettability would be highly beneficial, but is lacking in the art.

SUMMARY OF THE INVENTION

The present invention provides a novel process, and products thereof, for softening cellulose pulp by using a new combination of chemical softening agents, which includes both a debonder and a plasticizer. This softening treatment converts ordinary fluff pulp sheets into softened sheets of limp fibers having little affinity for each other (i.e., plasticized and debonded pulp). Thus, the resulting pulp is both easier to fluff (refiberize) and subsequently densify into airlaid pads formed from the individualized fibers after comminution. In addition, the absorbency and wettability of the cellulose fibers is not compromised by the softening process of the invention.

Practice of the invention using both a debonder and a plasticizer considerably lowers the energy requirement for converting pulp fiber sheets into absorbent products. Thus, the process of the invention reduces the cost of manufacturing products produced from refiberized comminuted pulp as a result of lower energy demand, higher throughput, and decreased wear on equipment. These are surprising and unexpected benefits of the present invention which could not previously be obtained from using either a conventional debonder or plasticizer alone to soften pulp.

In one embodiment, the invention provides a process for softening cellulose pulp comprising the step of contacting the pulp with an aqueous solution containing a debonder and a plasticizer in combination.

In another embodiment the invention provides a novel debonding agent, propylene carbonate, for use as a debonder alone, or together with a plasticizer in accordance with the process of the invention for softening cellulose pulp.

The invention further provides a softened pulp produced according to the processes of the invention for use in an absorbent product.

DETAILED DESCRIPTION OF THE INVENTION

Figure 1:
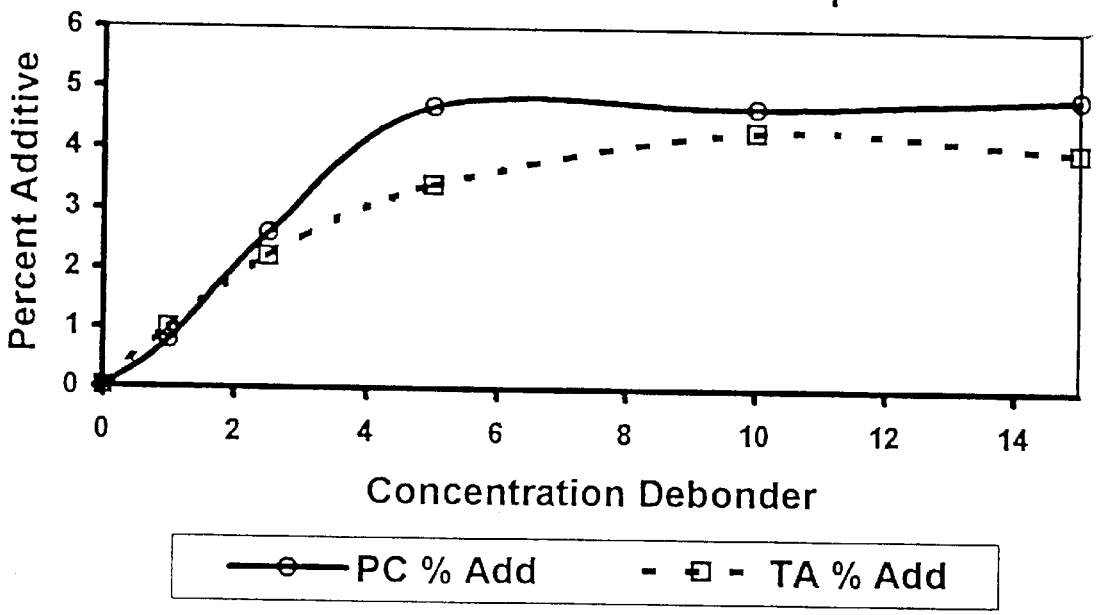
FIG. 1 is graph showing the change in tensile strength of pulp sheet treated with the debonders propylene carbonate and triacetin at 5, 10, and 15% by wt. solutions.

All references cited in this application are incorporated by reference. In the event of a conflict between the disclosure of this application and any of the references incorporated herein, including a conflict in terminology, the disclosure of this application governs.

As used herein, softening agents, compounds or compositions include any compound selected from debonders and plasticizers which can soften cellulose pulp. Pulp which is "modified", has been treated or contacted with a softening agent.

Debonders used in the present invention for softening cellulose fibers include any of the traditional cationic debonders known in the art, in addition to lower alkyl acid esters and cyclic esters of polyhydroxy compounds, alkyl ethers, and aryl ethers.

Preferred debonders of the invention include propylene carbonate, triacetin, propylene glycol diacetate, 2-phenoxyethanol, and mixtures thereof.

Propylene carbonate, the cyclic ester of propylene glycol and carbonic acid, is a polar, aprotic solvent having a high boiling point, and widely used as a solvent for a variety of polymers, (e.g., U.S. Pat. Nos. 5,580,922, 5,554,657 and 5,629,277). The present inventor has unexpectedly discovered that propylene carbonate is also an effective debonding agent for cellulose fibers which has no attendant adverse effects on wettability or absorbency of sheeted and airlaid products formed from treated pulp. The debonding action of propylene carbonate is similar to that exhibited by the non-cyclic esters of polyhydroxy compounds, such as triacetin.

In one embodiment, a debonder of the invention is used in combination with known plasticizers for softening cellulose. Plasticizers for use in the present invention include polyhydroxy compounds, lower alkyl amines and diamines, urea, and substituted ureas, such as tetramethylolurea, mono- and di-saccharides, glycols, and oligomers thereof. Preferred plasticizers for use in the invention include dextrose, glycerol, and poly(ethyleneoxide).

A preferred debonder/plasticizer combination is propylene carbonate and glycerol or other polyhydroxy compound, triacetin and glycerol, and propylene carbonate and dextrose.

Debonders and plasticizers of the invention are commercially available. Propylene carbonate is available in bulk from Huntsman Corporation (Houston, Tex.); triacetin and ethylene glycol diacetate are available from Eastman Chemical Company (Kingsport, Tenn.); glycerol is available from Ashland Chemical Company (Columbus, Ohio); and dextrose is available from Spectrum Bulk Chemicals (Gardena, Calif.).

In use, the softening compositions, which can include both a debonder and a plasticizer, effectively debonds the fibers in a pulp sheet to reduce interfiber associations, without compromising the subsequent densification process. This results in lower tensile strength (indicator of debonding) of the treated pulp sheet and easier comminution into individual fibers. The plasticizing agent of the softening composition penetrates the fibers to internally soften or plasticize them. This results in a readily-densified dry-formed absorbent product.

In the laboratory it is most convenient to simply saturate comminution pulp sheet with the aqueous softening treatment solution by immersion followed by gentle blotting. In an actual manufacturing process, the softening additive might be sprayed or otherwise applied to the pulp sheet on-line either before or after the sheet enters the drying stage. The softening solution could also be added to the pulp slurry prior to forming the sheet. On an airlaid production line, the softening solution could be sprayed or otherwise applied to the pulp sheet as it is unrolled and fed to the hammer mill or other comminution equipment.

The amount of softening solution to be added to the pulp sheets depends entirely on the concentration of the additives in the treatment solution and the target concentration desired in the product. The treatment time is not important (i.e., it does not impact softening properties of treated pulp), and can range from seconds to days.

The treatment solution may include from 2–99 wt. % of debonder and plasticizer. Preferably, the concentration in the solution is in the range of 3–7% wt. %

Procedure for Tensile Testing of Sheeted Materials

A Thwing Albert Intelect II Tensile tester Model No. 1450-24-A was used to measure the breaking strength of dry sheeted cellulose strips. Tensile strength is reported in pounds of force per inch of sample width. The samples are cut into strips, in the machine direction of the sheets, measuring 4.5 inches by 1 inch. If the breaking strength exceeds 100 pounds per inch, the samples are tested at a width of 1.5 cm. The tensile testing is done in a temperature and humidity controlled laboratory 23±1° C. (73.4±2° F.) and 50±5% relative humidity) and the samples are allowed to equilibrate at least 2 hours before testing. Measurements are done in duplicate or triplicate and the results averaged.

The following procedures can be used to test the properties of the resulting softened cellulose pulp.

Procedure for Measuring Disintegration Energy

Comminution pulp sheets formed by conventional wet laying techniques at Buckeye Technologies, Inc. are treated with the softening additives, optionally redried, and cut into 2"×30" strips with the 30" dimension in the machine direction. Comminution pulp is typically approximately 700 grams per square meter in basis weight. The actual weight of each strip is recorded and the strips are individually fed into a Kamas laboratory hammermill, Kamas Industries AB Type KVARN H 01, for disintegration. The hammermill has a screen size of 16–17 mm and is run at 3000 rpm at a feed rate of 8 ft/min. The power consumption required for disintegration is measured and is commonly expressed as KWH/ton (kilowatt-hour per ton of pulp). Residual moisture in the pulp sheet and even the relative humidity can affect disintegration energy. Accordingly, strips of untreated control sheet are run each time samples are measured in order to have a benchmark for comparison. The results for any given day can then be normalized to any other day by multiplying by the ratio of the disintegration energies of the control strips.

Procedure for Preparation of Specimens for Testing Absorbent Capacity, Strength, and Fluid Transport Properties of Airfelts The cellulose fibers used in the test airfelt pads were prepared from never-dried cellulose pulp obtained from Buckeye Technologies, Inc. and were either treated with the softening agents of this invention or were left untreated after being formed into 700 gsm sheets on a laboratory paper machine (Dynamic Former by Alimand). This machine sprays a dilute slurry of pulp fibers onto a rapidly spinning drum and thereby forms an 8.5"×35" hand sheet with a true machine direction. The dry sheeted pulp was converted into an airfelt which did not contain a large quantity of fiber clumps by cutting the pulp into 2"×30" strips. The strips were individually fed into a Kamas Industries AB Type KVARN H 01 laboratory hammermill to produce a uniform fluff.

A laboratory scale padmaker which duplicates the commercial padforming process was used to air lay the dry uniform fluff into airfelt pads in a conditioned environment. In order to overcome the effects of disintegrating the comminution pulp in an unconditioned atmosphere and expose the pads to the conditioned environment, the pads were allowed to remain in the padmaker for 4–5 minutes while conditioned air is pulled through the pad. Additionally, this procedure overcomes the possible effect of the compressed air used in padmaking not being at 50% relative humidity.

A ply of tissue which measured 14-½×14-½ was placed on the forming screen of the padmaker. The tissue completely covered the forming screen and curved up the sides. This tissue represents the bottom side of the airlaid airfelt pad. An appropriate amount of the fluff sample was added to the padmaker in four equal increments with the pad rotated 90° between each increment to form a uniform pad. After the fluff was added to the airlaid airfelt pad, the forming screen was removed with the airfelt pad on it and carefully transferred to a smooth flat surface. A second covering tissue was marked to indicate the top side of the airlaid airfelt pad and placed on top of the pad. A weight which measured 14"×14" was placed on the pad in a manner which did not disturb the formation of the airfelt pad. The weight was allowed to remain on the airfelt pad for a minimum of 5 minutes and then carefully removed. The pad was cut into a 12-¾×12-¾ square by removing approximately the same from each edge with a standard paper cutter board. This pad was cut into nine square pads which measured 4-¼×4-¼ each. The airlaid felt pads were then stored in an area maintained at 23±1° C. (73.4±2° F.) and 50±5% relative humidity until needed for testing. The covering tissues on the 4-¼×4-¼ pad were carefully removed and the pad was placed on the bottom half of an aluminum press plate. The press plate is made from two blocks of aluminum measuring 6"×6"×1". One 6"×6" face of each block was machined to a perfectly flat surface. Aligning pins are fixed near two corners of one plate. Corresponding holes are formed in the other plate for receiving the pins. The top half of the press plate was placed over the pad to be pressed and the entire press plate was placed on a Carver hydraulic press (Model No. 16600-224). Each pad was pressed at the appropriate pressure to produce the desired density. Since the size of the pad increased as a result of pressing, the pad was trimmed to measure 4"×4" each and weighed. After waiting 120 seconds for delayed rebounding, the thickness of each pad was measured. The density of the pad was then calculated according to the following formula:

$$\text{Density in grams/cc of a } 4'' \times 4'' \text{pad} = \frac{0.000379 \times \text{weight(gms)}}{\text{thickness(inches)}}$$

Procedure for Drip Capacity Test

In order to demonstrate the fluid transport capability of an absorbent structure made from cellulose fibers treated with debonding and/or plasticizing agents according to the present invention, airfelt pads were prepared according to the procedure described above. The fluid transport capability of each airfelt pad was measured by determining the drip capacity in milliliters of liquid per grams of cellulose in an airfelt pad without covering tissues. Urine was simulated by using 0.9% NaCl prepared by dissolving 9 grams of NaCl in 991 grams of distilled water. A burette was filled with the saline solution and the flow rate of the pipette was adjusted to deliver 2 ml of urine per second. The delivery tip on the stopcock of the burette was positioned 1" above and perpendicular to a cube made of 0.5 inch wire mesh. The cube was placed in a pan for receiving the excess fluid. The top face of the cube was maintained in a level position.

Immediately after pressing to the desired density, the pad was placed on the cube so that the fluid impact point is at a crosswire position. Simultaneously, the stopcock on the burette was opened and the timer was started. The test fluid was allowed to drip at a controlled rate onto the center of the pad. The timer was stopped when the first drop of liquid was released by the pad and fell into the pan. The time required for the first drop of liquid to pass through the pad was recorded. The wet pad was removed from the cube and discarded. The cube was dried completely and returned to the pan. The above procedure was repeated on two more airfelt pads, which were identical to the first in weight, density, and composition. The weight, density, and time were recorded for each of the three individual pads. The drip capacity for each pad was calculated according to the following formula and averaged with the others:

$$\text{Drip capacity in milliliters liquid/gram sample} = \frac{\text{Time in sec.} \times 2}{\text{Weight (grams) of } 4'' \times 4'' \text{pad}}$$

Procedure for Total Absorptive Capacety

In order to demonstrate the absorptive capability of an absorbent structure made from the cellulose fibers treated with the softening agents according to the present invention, airfelt pads were prepared according to the procedure described above. The absorptive capacity was measured on airfelt pads without the covering tissue. A 4"×4" airfelt pad, at nominally 300 gsm and 0.2 g/cc density, was placed on a tared plastic plate and weighed. The pad and plate are placed on a 60 degree inclined platform. The pad is saturated with 0.9% NaCl. The excess liquid is allowed to drain away and removed with blotters. The plate and saturated pad are weighed.

The total absorbent capacity is calculated as:

$$\text{Absorptive capacity (g/g)} = \frac{\text{wet weight} - \text{dry weight}}{\text{dry weight}}$$

Procedure for Burst Strength Test

In order to demonstrate the burst strength of an absorbent structure formed from the cellulose fibers treated with a debonding agent according to the present invention, airlaid airfelt pads were prepared according to the method of the present invention. Airfelt pads, which contained debonded cellulose fibers or untreated cellulose fibers, were prepared according to the procedure described above for use as control pads. The burst strength of each pad was determined by measuring the force required for the ball penetrator of a conventional tensile testing apparatus to reach the point of no resistance in a pad without covering tissues.

A Thwing Albert Intelect II tensile tester was used to measure the burst strength of the airfelt pads. The tensile tester includes a clamp platform and clamp plate for securing a test pad in a horizontal position between the platform and the plate. The platform and clamp plates are provided with corresponding holes for receiving a ball penetrator which is positioned directly above the holes. The tensile tester was set up in compression mode and attached to a gram cell, which monitors any resistance encountered by the 1.5 cm diameter ball penetrator.

Immediately after pressing to a density of 0.2 g/cc, the pad was placed over the hole on the clamp platform, and the clamp plate was securely clamped over the pad to hold the pad in place. The Intelect was started, with the crosshead set to travel downward at 0.5 in/min or 1.27 cm/min. As the ball penetrator moves down and contacts the pad, an ever-increasing force measurement shows continuously on the monitor. The penetrator continues to move completely All through the pad until reaching the point of no resistance, which is typically when the pad breaks. At this point, the crosshead automatically rebounds upward to the starting position. The maximum force value on the monitor of the Intelect was recorded. This process was repeated two times with new airfelt pads. Three pad values were averaged and the maximum force value was reported in grams.

Procedure for Vertical Wicking Rate

Airfelt pads are densified to 0.1 g/cc, trimmed to exactly 4 inches by 4 inches and precisely mounted between plastic plates containing electronic moisture sensors. The sample holder is lowered ¼inch into the saline reservoir and the timer starts automatically when the liquid rises ¼ inch above the level of the reservoir and contacts the lower row of sensors. The timer stops automatically when the moving liquid front reaches the upper electrodes (1.5 inches above the first row). The results are reported in cm/sec.

Procedure for Inclined Wicking Rate of Sheeted Cellulose Pulp

For this test, a plastic plate equipped with a scale in inches is mounted at an angle of 45° from vertical over a reservoir of 0.9% NaCl tinted red with ordinary food coloring. The pulp sheet (densified from an air laid pad) is placed on the inclined plate ¼ inch into the reservoir and a stopwatch is started. The time for the advancing liquid front to reach 3.5 inches is recorded. The results are tabulated in the units of inches per second. In this experiment, sheeted cellulose pulp from Buckeye Technologies, Inc. was soaked overnight in distilled water to rehydrate the pulp. The swollen sheets were dewatered on papermaker's felt by passing through a nip roller and then were sprayed with solutions of the softening agents. From the calculated amount of dry pulp in the treated sheet and the weight of wet add-on, the calculated add-on in weight percent ("% add-on") was determined. In the following table, PC is propylene carbonate and G is glycerin. Inclined wicking rate at either density was unaffected by the softener treatments.

Procedure for Disintegration Efficiency (DE)

This method is used to determine the disintegration or fluffing efficiency of comminution pulps. The test measures the quantity of disintegrated pulp that fiberizes enough to pass through a 14-mesh screen (1.4 mm openings). Fluff from, for example, the Kamas laboratory hammermill is divided into two accurately weighed 5.00 gram portions. One portion is transferred to the 14-mesh screen of the vacuum-pneumatic separation chamber. The apparatus comprises a standard 8-inch diameter Tyler sieve with a clear plastic lid mounted on a clear plastic cylinder equipped with an outlet to a vacuum cleaner and one to a manometer. The clear plastic chamber also has a pneumatic inlet with a flexible coupling so the stream of compressed air can be directed to thoroughly agitate the fluff sample viewed through the clear plastic lid. After two minutes of simultaneous agitation with compressed air and removal of disintegrated pulp passing through the 14-mesh screen at 3 cm Hg of vacuum, the portion remaining on the screen is recovered. The procedure is repeated with the second 5.00 gram portion of fluff. The two portions recovered from the screen are combined and weighed. The weight of disintegrated fluff is 10 grams minus the weight of the nits or fiber bundles recovered from the 14-mesh screen.

$$\text{Disintegration efficiency} = \frac{\text{10 grams} - \text{weight of undisintegrated fluff}}{\text{10 grams}} \times 100$$

The following Examples are provided to further teach the invention, the scope of which is intended to be limited only by the claims.

EXAMPLES

Since cellulose pulp has a natural residual moisture content proportional to the temperature and relative humidity under which it has been stored, and to the severity of drying conditions to which the fibers have been most recently subjected, a control strip of pulp was included in the experiments. This permitted calculation of the extent of reaction or incorporation of a chemical softening treatment in pulp, by obtaining an initial weight and including a control sample (no softening treatment) of pulp in the study. The control was used to determine the moisture content of the starting material so the actual weight gain of the treated samples could be determined.

In the following examples, the extent of incorporation of softening agent, i. e., the percent additive in the treated sheet, was calculated by comparing treated samples with a control strip saturated with deionized water and subjected to the same drying conditions as in experimental treatments. The weight difference between the original control and the dried control was used to calculate the actual pulp weight in the original sample. The final percent additive is the difference between the final dry weight of the treated sheet and the adjusted original dry weight divided by the final dry weight. In addition, tensile strength in pounds of force per inch of width of pulp sheets treated in accordance with the process of the invention was determined by conventional means.

If the dissolved softening agent is rapidly absorbed by the pulp, the blotted solution may be depleted of these agents, thus leading to higher than expected loadings of softening agents in the final pulp product. Conversely, if the water is more strongly attracted to the pulp, the excess solution may be enriched in softening agent. If the softening agent is a humectant, the residual moisture level in the treated pulp might be higher than in pulp exposed to only water, leading to a high reported weight gain of the pulp which is erroneously attributed to the treatment chemical. Thus, in the following Examples, it was assumed that the solution retained in the wet pulp comprises the same softening agents as prepared in the original solution.

Example 1

In this experiment, 1.5 by 6.0 inch (about 4.5 g) strips of Southern Softwood Kraft pulp sheets were saturated with 5% aqueous solution containing softening agents, as indicated in the tables, and excess solution was removed by momentary blotting. The strips were dried at 109° C. for 60 minutes.

Ease of fiberization, which unequivocally indicates debonding and softening of pulp fibers, was assessed using a laboratory blender operated at a fixed speed and time on 0.7 g samples of modified pulp sheets. When fully opened by impacting the blades of the blender, the fluff gathers near the top of the blender away from the blades. The samples were fluffed as completely as possible in the blender and subsequently formed into 2.25 inch diameter pads at a basis weight of 390 gsm. After pressing for 10 seconds at 30 psi and again at 60 psi the densities of the sheets were measured.

Water treatments alone were shown to slightly weaken the sheet, versus untreated samples, but decreased the density of the airlaid pads, as shown in Table 1.

Pulp treated with glycerol, a known plasticizer for cellulose, had reduced tensile strength, indicative of softening. However, this pulp was difficult to fiberize in the blender, since fiberization took more than 20 seconds. Pressing the pad made from the glycerol-treated fibers yielded a dense sheet, which was expected for a plasticized fiber.

Pulp sheets treated with triacetin or propylene carbonate (PC) had low tensile strength and fluffed readily, both tests being supportive of extensive debonding in the pulp sheets.

TABLE 1

Saturation of Pulp Sheets

| Pulp Treatment | Percent Add-on | Tensile Strength (lbs/inch) | Blender Fiberization, sec. | Airlaid Density (g/cc) |
|---|---|---|---|---|
| untreated | 0 | 107.1 | 20+ | 0.24 |
| Water | 0 | 94.9 | 20+ | 0.21 |
| Glycerin | 6.5 | 68.2 | 20+ | 0.26 |
| Propylene carbonate | 5.0 | 52.8 | 10 | 0.23 |
| Triacetin | 5.4 | 45.0 | 10 | 0.21 |

In Examples (2–5), comminution pulp sheets (Foley fluff; Buckeye Technologies Inc.) were cut in the machine direction into 1.5 inch by 6.0 inch strips. The strips were weighed to the nearest milligram (approximately 4.5 g) and then saturated with softening treatment solutions as described in each Example. Excess treatment solution was blotted away, the wet sheet was weighed, and placed in a laboratory convection oven at various temperatures to drive off the water.

Example 2

Plasticizers and Mixtures of Plasticizers and Debonders

Strips of pulp sheet were treated with various plasticizing agents and also with the plasticizers mixed with aqueous propylene carbonate (debonder), as indicated in Table 2. Pulp sheets were saturated with 5% solutions of each softening component separately and one solution which contained 5% of each component. 5% is the strength of the solution. Table 2 shows the amount of additive as % of overall product. The sheets were dried in a convection oven at 109° C. for 60 minutes.

The debonding effects, demonstrated by percent add-on of absorbed treatment solutions, were nearly additive with propylene carbonate (PC) and dextrose used in combination. Together these softening agents were more effective as debonders of the pulp sheet than when each was used separately.

Samples treated with glycerol in combination with propylene carbonate had a tensile strength that was only slightly lower than the average of a sample treated with each separately.

Samples treated with urea, another known plasticizer for cellulose, showed no apparent debonding activity. Samples treated with urea in combination with propylene carbonate, showed tensile strength that coincided with the average of samples treated separately with these agents.

TABLE 2

Plasticizers, Debonder, and Mixtures

| Pulp Treatment | Additive % of Product | Tensile Strength (lbs./in) | Average Tensile Strength (lbs./in) |
|---|---|---|---|
| Untreated Pulp Sheet | 0 | 107.1 | |
| Dextrose | 7.1 | 86.5 | |
| Propylene carbonate | 5.0 | 52.8 | |
| Dextrose and Propylene carbonate | 11.5 | 43.4 | 65 |
| Glycerol | 6.2 | 69.2 | |
| Glycerol and Propylene carbonate | 8.1 | 57.7 | 61 |
| Urea | 6.0 | 109.9 | |
| Urea and Propylene carbonate | 7.6 | 81.6 | 81.4 |

Example 3

Temperature Experiment

Drying temperature had no consistent effect on the efficiency of propylene carbonate treatment or the extent of modification (softening) of fibers. Pulp sheets were saturated with 5% aqueous propylene carbonate and dried at different temperatures, as shown in Table 3. The efficiency of softening treatment is expressed as the final dry weight gain as a percentage of the amount of propylene carbonate added to the pulp in the wet stage. The extent of treatment is expressed as the weight percent of the final product.

TABLE 3

Drying Temperature Study

| Temperature° C. | Efficiency % | % Propylene Carbonate |
|---|---|---|
| 88 | 62.3 | 4.8 |
| 100 | 56.4 | 4.4 |
| 125 | 59.4 | 4.5 |
| 135 | 60.1 | 4.4 |
| 150 | 57.8 | 4.5 |

Example 4

Debonder Retention Study

Experiments were conducted to determine the capacity of cellulose pulp to retain organic ester debonders at varying temperatures. Pulp sheets were saturated with 5% solutions of softening agent and dried in a 135° C. oven.

The results of these tests indicate that cellulose pulp has a finite capacity for absorbing and retaining organic ester debonders, but is somewhat dependent on the softening agent used and drying conditions. Most of the weight gain for samples occurred in the first treatment. A second treatment yielded only a slight increase in the amount of debonder retained in the pulp. Pulp samples treated only with triacetin showed higher total weight gain when the samples were dried first at 25° C. and then at 109° C. after each treatment. The overall weight gain under these conditions was twice that of triacetin treatments followed by drying at 135° C. Temperature had little effect on weight gain of samples treated with propylene carbonate (PC).

TABLE 4

Debonders, Sequential Treatments

| 1st Treatment | Weight Gain % | 2nd Treatment | Total Weight Gain % |
|---|---|---|---|
| Triacetin, 135° | 4.2 | Triacetin, 135° | 4.3 |
| Triacetin, 135° | 4.24 | Propylene Carbonate, 135° | 5.08 |
| Propylene Carbonate, 135° | 4.4 | Propylene Carbonate, 135° | 5.2 |
| Propylene Carbonate, 135° | 4.5 | Triacetin, 135° | 5.03 |
| Triacetin, 25° | Not det. | Triacetin, 109° | 8.48 |
| Propylene Carbonate, 25° | Not det. | Propylene Carbonate, 109° | 4.75 |

Example 5

Debonder Loading

Pulp sheets were saturated with 5, 10 and 15% solutions containing triacetin or propylene carbonate, momentarily blotted, and dried for 60 minutes in a 135° C. convection oven. Propylene carbonate is miscible with water so the initial wet loading on pulp can be varied by varying the concentration of the treating solution. Triacetin has limited solubility in water so the 10 and 15% data points were simulated by multiple treatments with 5% triacetin. See Table 5 and FIG. 1. A control treated with water was included to correct for moisture. The final treatment level was calculated as the weight gain attributed to the debonder as a percentage of the final weight.

As shown in FIG. 1, when the pulp was dried at 135° C., the pulp absorbed up to about 5% of the propylene carbonate or triacetin solution by weight of treated pulp.

TABLE 5

Debonder Concentration Effects at 135° C.

| Conc. | % Propylene Carbonate | % Triacetin |
|---|---|---|
| 0 | 0 | 0 |
| 1 | 0.8 | 1 |
| 2.5 | 2.6 | 2.2 |
| 5 | 4.7 | 3.4 |
| 10 | 4.7 | 4.3 |
| 15 | 4.9 | 4 |

Example 6

Tensile Strength/Additive Loading

Figure 2:
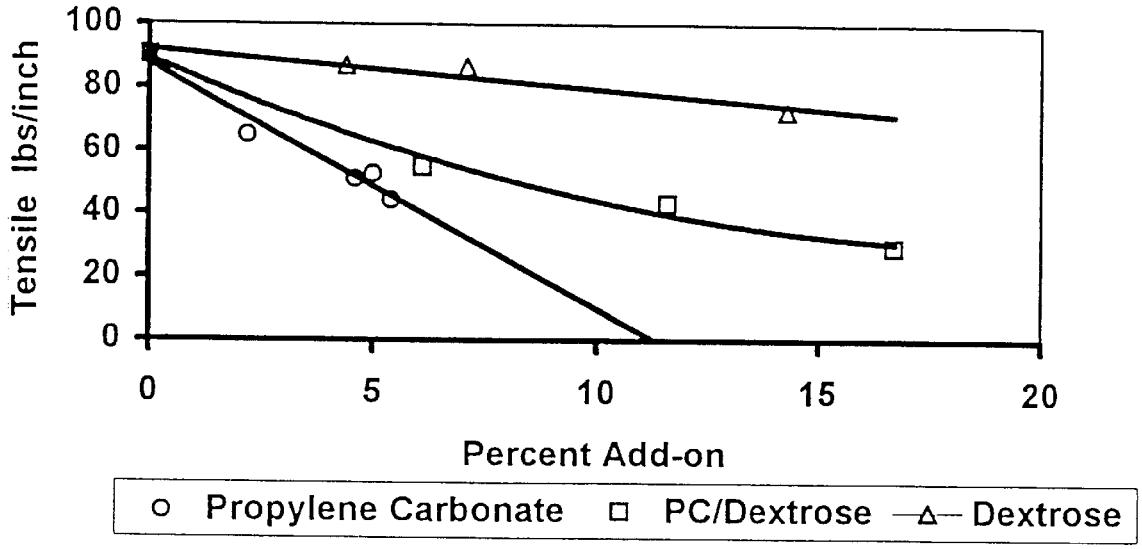
FIG. 2 is a graph showing the change in tensile strength of pulp sheet treated with debonder alone, plasticizer alone, or a mixture of plasticizer and debonder. Propylene carbonate and dextrose, the debonder and plasticizer respectively, were employed.
Figure 3:
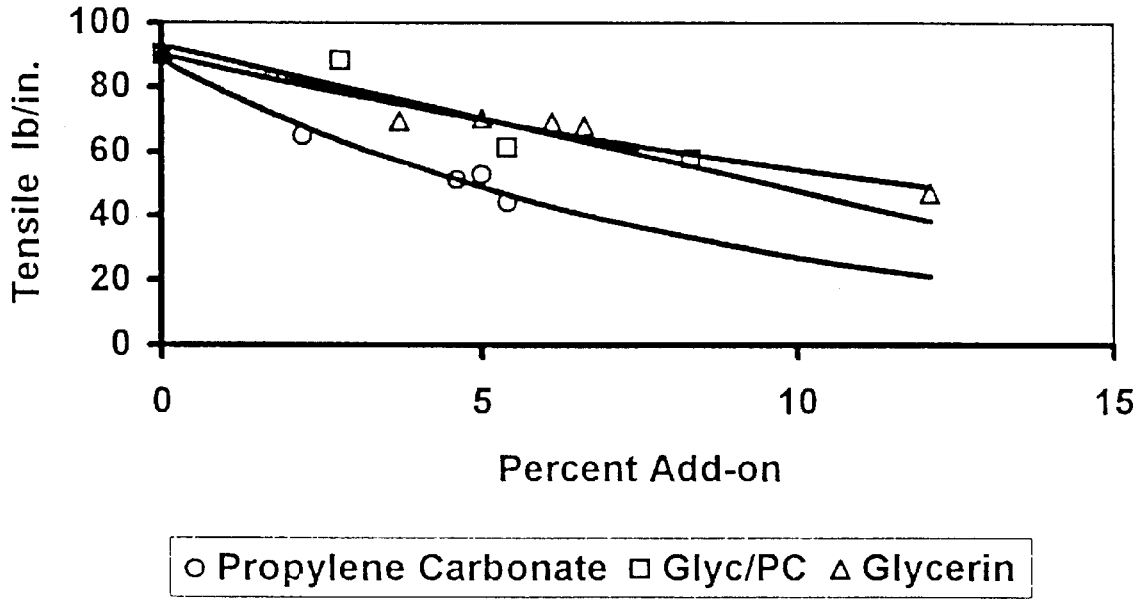
FIG. 3 is a graph showing the change in tensile strength of fibers treated with debonder alone, plasticizer alone, or a mixture of plasticizer and debonder. Propylene carbonate and glycerin, the debonder and plasticizer respectively, were employed.

This experiment tested tensile strength of pulp sheets in pounds/inch of width as a function of the extent of modification after saturating pulp sheets with various dilute solutions of plasticizer, debonder, and 1:1 mixtures. The additive loading is expressed as weight percent of the final pulp product. The results are shown in Table 6 and plotted in FIGS. 2 and 3. Table 6 has three sections: plasticizers, debonders, and blends of the two. Tensile strength of the pulp sheet is an indication of debonding effects. Even the plasticizers appear to weaken the sheet, glycerin more so than dextrose. In combination with propylene carbonate, however, dextrose appears more effective than glycerin. As debonders, propylene carbonate and triacetin are comparable up to a loading of 5.4% (the upper limit for propylene carbonate addition). FIG. 2 plots dextrose and propylene carbonate data from Table 6 and FIG. 3 plots glycerin and propylene carbonate.

TABLE 6

Tensile Strength of Pulp Sheet as a Function of Additive Loading

| | Plasticizers | | Debonders | | Blends | |
|---|---|---|---|---|---|---|
| % Additive | Glycerin | Dextrose | Triacetin | Propylene Carbonate (PC) | PC/Dextrose | PC/Glyc. |
| 0 | 90.2 | 90.2 | 90.2 | 90.2 | 90.2 | 90.2 |
| 2.2 | | | | 65.1 | | |
| 2.8 | | | 43.6 | | | 88 |
| 3.7 | 69.4 | | | | | |
| 4.4 | | 87 | 44.8 | | | |
| 4.6 | | | | 51.2 | | |
| 5 | 70.2 | | | 52.8 | | |
| 5.4 | | | 45 | 44.4 | | 61.3 |
| 6.1 | 69.2 | | | | 54.9 | |
| 6.6 | 68.2 | | | | | |
| 7.1 | | 86.5 | | | | |
| 8.3 | | | | | | 57.7 |
| 8.5 | | | 31.2 | | | |
| 11.6 | | | | | 43.4 | |
| 12.1 | 47.3 | | | | | |
| 14.3 | | 72.6 | | | | |
| 16.7 | | | | | 29.5 | |

Note: As shown by the gaps in the table, not all formulations were tested at all levels of treatment Example 7

Saturation Treatment of Pulp Sheet

Tensile measurement is one way of measuring debonding effects of pulp additives. Another test of the internal strength of a sheet of cellulose fiber material is the Kamas mill energy of disintegration. In Table 7, the Kamas energy, tensile strength, and disintegration efficiency of the treated pulp sheets were determined. Dry strips of comminution pulp (Buckeye Technologies Inc.) were treated by saturating the strips in the respective solutions, blotting the excess solution, and drying in a 109° C. convection oven. In Table 7, propylene carbonate is abbreviated as PC, triacetin as TA, and 200 molecular weight polyethylene glycol as E-200. Since the Disintegration energy (KE) depends on many variables, a control untreated pulp sheet is run with each set of samples. The samples are listed by decreasing Kamas Energy.

TABLE 7

Disintegration Energy and Tensile Strength

| Treatment | % Loading | KE (KWH/ton) | Tensile Strength (lbs/in.) | DE (%) |
|---|---|---|---|---|
| none | 0 | 30.2 | 101.3 | 89 |
| water | 0 | 27.3 | 93.4 | 94 |
| 1.25% PC/E-200 | 3.5 | 22.9 | 49.8 | 98 |
| 2.5% PC/E-200 | 6.5 | 21.0 | 45.4 | 96 |
| 1.25% TA/Dextrose | 3.9 | 20.5 | 47.8 | 97 |
| 1.25% TA/E-200 | 3.7 | 18.4 | 41.7 | 97 |
| 2.5% TA/E-200 | 6.4 | 16.8 | 35.2 | 97 |
| 2.5% TA/Dextrose | 7.4 | 16.3 | 40.6 | 98 |

Even water alone as a treatment causes a weakening of the pulp sheet apparent in tensile, disintegration energy, and disintegration efficiency. The tensile strengths of the sample sheets show a greater relative drop than the disintegration energies with exposure to the softening treatment. Tensile strength directly correlates to disintegration energy. The more concentrated treatment solutions yield lower energy and strength values.

Examples 8–10

Treatment of Rehydrated Pulp Sheet

Sheeted cellulose comminution pulp from Buckeye Technologies, Inc. was soaked overnight in distilled water to rehydrate the pulp. The swollen sheets were dewatered on papermaker's felt by passing through a nip roller and then were sprayed with solutions of the softening agents. This procedure was used in two designed experiments (three levels and two factors) and two simple experiments (three levels of one factor) as a way to simulate treating a never-dried pulp sheet without actually having to make the sheet. From the calculated amount of dry pulp in the treated sheet and the weight of wet add-on, the calculated add-on in weight percent was determined. In the following tables, PC is propylene carbonate and G is glycerin. The dry sheets were cut into 2" by 30" strips in the machine direction for feeding to the Kamas mill. The modified fluff samples prepared in the experiments tabulated in Tables 8–10 were blown into 450 gsm handsheets which were densified in a Carver press and in Table 8, subjected to inclined wicking measurements (45° from vertical). The rate is calculated from the elapsed time required for the advancing liquid front to reach a distance of 3.5 inches. In the designed experiment shown in Table 9 and the separate additives experiment in Table 10, the disintegration energy is reported and the left-over ends of the strips fed to the hammermill were submitted for tensile testing. The disintegration efficiency is determined and the ease of densification is assessed. After preparing 450 gsm air felt pads from the fluff, the pads were compressed momentarily in the Carver press at 5,000 pounds of pressure on a 4"×4" pad (312 psi). The thickness was measured and the actual density calculated. The higher the resulting density, the more easily the fibers densify and stay densified. This is used to detect the presence of a cellulose plasticizer.

TABLE 8

Inclined Wicking Study

| Treatment | Density (g/cc) | Rate @ 3.5" (inches/sec.) |
|---|---|---|
| Untreated | 0.096 | 0.10 |
| Water | 0.095 | 0.09 |
| 1.5PC - 1.5G | 0.110 | 0.10 |
| 2.4PC - 2.4G | 0.109 | 0.10 |
| 3.2PC - 3.2G | 0.104 | 0.10 |
| 1.5PC - 2.3G | 0.110 | 0.11 |
| 1.6PC - 3.2G | 0.118 | 0.11 |
| 2.5PC - 1.6G | 0.118 | 0.11 |
| 2.4PC - 3.3G | 0.108 | 0.11 |
| 3.3PC - 1.6G | 0.095 | 0.10 |
| Untreated | 0.200 | 0.11 |
| 3.3PC - 1.6G | 0.200 | 0.11 |
| 2.4PC - 3.3G | 0.220 | 0.11 |
| 1.5PC - 1.5G | 0.200 | 0.11 |

TABLE 9

Dual Treatment of Rehydrated Pulp

| Treatment | Disintegration (KWH/ton) | Tensile Strength (lbs/in.) | 5 K Density (g/cc) |
|---|---|---|---|
| Water | 23.9 | 78.6 | 0.53 |
| 2.0 PC - 4.06 G | 19.9 | 51.4 | 0.60 |
| 2.02 PC - 2.02 G | 18.8 | 31.3 | 0.56 |
| 2.1 PC - 3.17 G | 18.8 | 51.5 | 0.58 |
| 3.06 PC - 2.04 G | 13.5 | 46.3 | 0.56 |
| 3.16 PC - 3.16 G | 17.4 | 33.3 | 0.60 |
| 3.28 PC - 4.37 G | 17.3 | 38.2 | 0.64 |
| 4.11 PC - 2.05 G | 16.2 | 37.0 | 0.57 |
| 4.2 PC - 3.16 G | 16.6 | 53.8 | 0.61 |
| 4.57 PC - 4.57 G | 15.1 | 32.6 | 0.62 |

TABLE 10

Separate Additives on Rehydrated Pulp

| Treatment | Disintegration (KWH/ton) | DE (%) | Tensile Strength (lbs./inch) | Density (g/cc) |
|---|---|---|---|---|
| Water | 18.8 | 85 | 74.7 | 0.48 |
| 2.0 PC | 12.5 | 91 | 48.6 | 0.52 |
| 3.0 PC | 10.8 | 89 | 52.7 | 0.50 |
| 4.0 PC | 16.4 | 92 | 48.4 | 0.55 |
| 5.0 PC | 11.5 | 89 | 47.6 | 0.51 |
| 2.0 G | 12.0 | 88 | 56.5 | 0.55 |
| 3.0 G | 23.1 | 91 | 50.5 | 0.59 |
| 4.0 G | 19.7 | 81 | 61.0 | 0.57 |
| 5.0 G | 19.0 | 85 | 59.8 | 0.61 |

Statistical analysis on both designed experiments (Tables 8 and 9) showed no interaction between debonder and plasticizer. Treating rehydrated cellulose pulp with propylene carbonate and glycerin has no effect on wicking rate of 0.9 % saline in densified air formed fluff pads. Kamas energy of disintegration and tensile strength of the sheet generally decrease with higher levels of propylene carbonate, while attained density after the 5,000 pound pressing correlates to the amount of glycerin in the treatment solution. In Table 10, the propylene carbonate treatment alone reduced the disintegration energy and tensile strength and improved the fluffing efficiency. Glycerin alone actually increased the disintegration energy in three of four samples and only improved fluffing efficiency in two of the four samples.

Example 11

Treatment of Never-Dried Cellulose Pulp

If the softening treatment is done in the pulp mill where the comminution pulp sheet is manufactured, there is the option to apply the treatment solution before the freshly formed sheet passes through the drying stage. This operation is simulated in the laboratory by redispersing in water never-dried pulp from the pulp mill and forming the pulp sheet using the laboratory handsheet former. After the first dewatering stage, the softening treatment is applied to the freshly formed sheets, which are then dried as usual and cut into strips for disintegration. As before, the composition of the softening treatment is expressed in weight percent of the final product.

TABLE 11

Treatment of Never-dried Pulp

| Treatment PC-Glyc. (Wt. %) | Kamas Energy (KWH/ton) | Disint. Effic. (%) | Density 5000 lbs (g/cc) | Tensile Strength (lbs/in.) | 2 ml Drip (ml/g) | Absorbent Capacity (g/g) | Burst Strength (grams) | Vertical Wicking (cm/sec) |
|---|---|---|---|---|---|---|---|---|
| 0-0 | 16.8 | 87 | 0.50 | 58.1 | 2.7 | 18.3 | 134.3 | 0.53 |
| 3-4 | 12.0 | 95 | 0.62 | 28.1 | 2.3 | 16.6 | 120.5 | 0.57 |
| 3-0 | 10.0 | 94 | 0.53 | 44.8 | 2.6 | 16.8 | 122.5 | 0.52 |
| 0-4 | 9.0 | 87 | 0.59 | 45.5 | 2.0 | 16.5 | 129.2 | 0.47 |

*PC is propylene carbonate and Glyc. is glycerin.

Never-dried pulp responds to the softening treatments of this invention in the same manner as once-dried pulp. Propylene carbonate, both alone and with glycerin, debonds the sheet as evidenced by reduced disintegration energy and improved disintegration efficiency. Glycerin alone effectively softened the sheet for disintegration, evident also in the tensile strength, but did not improve the efficiency of disintegration.

As expected from previous examples, the ease of densification (density attained by the 450 gsm air felt after momentary pressing under 5,000 pounds of pressure) is a function of the presence of glycerin as a plasticizer for the cellulose fibers. The vertical wicking test illustrates that the organic debonders of this invention, represented by propylene carbonate, have no adverse effects on the fluid transport ability of an air formed cellulose fiber structure. Absorbent capacity may be slightly reduced by the softening treatments, but some reduction is expected since it takes fewer treated fibers to reach the same weight as untreated ones.

Example 12

Treatment of Dry Pulp Sheet

Different final absorbent products may benefit from differing degrees of densification. One way for the converter to have the flexibility of producing a range of products without having to maintain an extensive inventory of different pulps is to do the pulp modification on-line. This is readily accomplished by spraying small amounts of concentrated solutions of the softening agents on the pulp sheet just prior to feeding the sheet to the hammermill. The real advantage of this approach is that the softening treatment can be carried out at the converter's facility instead of being limited to the pulp manufacturer. In the following examples, the amounts of propylene carbonate and glycerin added per sheet are held constant at 3 and 4%, respectively. The total amount of water in the sheet is adjusted in 2% increments from 12–20%.

TABLE 12

Treatment of Dry Pulp Sheet

| Treatment | Moisture (%) | Disintegration Energy (KWH/ton) | Disintegration Efficiency (%) | Tensile Strength (lbs/in.) | 5K Density (g/cc) |
|---|---|---|---|---|---|
| None | 6.3 | 25.8 | 89 | 101.0 | 0.51 |
| None | 12 | 20.6 | 78 | 102.0 | 0.52 |
| None | 14 | 18.8 | 78 | 87.6 | 0.46 |
| None | 16 | 18.5 | 74 | 85.5 | 0.44 |
| None | 18 | 21 | 77 | 95.3 | 0.42 |
| None | 20 | 16.8 | 79 | 98.3 | 0.46 |
| 3PC - 4G | 12 | 19 | 90 | 65.9 | 0.57 |
| 3PC - 4G | 14 | 16.4 | 93 | 71.1 | 0.59 |
| 3PC - 4G | 16 | 15.5 | 91 | 51.1 | 0.56 |
| 3PC - 4G | 18 | 18.5 | 89 | 60.7 | 0.59 |
| 3PC - 4G | 20 | 18.1 | 87 | 55.5 | 0.59 |

Simply spraying water on pulp sheet right before the hammermill causes a significant drop in disintegration energy at the expense of disintegration efficiency. The mixture of propylene carbonate and glycerin also reduces the disintegration energy but with the added advantage of not losing disintegration (fluffing) efficiency. The tensile strengths of the sheets treated only with water are significantly higher than those treated with debonder and plasticizer. The same amount of pressure generates a higher density for 450 gsm airfelt pads made from the fluffed pulp treated with propylene carbonate and glycerin.

What is claimed is:

1. A process for softening a cellulose pulp for comminution comprising contacting the pulp with an aqueous solution containing 2–99 wt. % propylene carbonate and 2–99 wt. % glycerol.

2. The process of claim 1, wherein the aqueous solution contains 3–7 wt. % propylene carbonate and 3–7 wt. % glycerol.

3. A process for softening a cellulose pulp for comminution comprising contacting the pulp with en aqueous solution containing 2–99 wt. % propylene carbonate and 2–99 wt. % dextrose.

4. The process of claim 3, wherein the aqueous solution contains 3–7 wt. % propylene carbonate and 3–7 wt. % dextrose.

5. A process for softening a cellulose pulp comprising the step of contacting the pulp with propylene carbonate present in an amount of about 0.1 to 50 wt. % of the cellulose fibers.

6. The softened pulp produced according to the method of claim 5.

7. An absorbent product comprising softened pulp produced from the process of claim 5.

8. A process for softening a cellulose pulp comprising the step of contacting the pulp with cyclic esters or carbonates of glycols present in an amount of about 0.1 to 50 wt. % of the cellulose fibers.

* * * * *